US005492236A

United States Patent [19]

Foy

[11] Patent Number: 5,492,236

[45] Date of Patent: Feb. 20, 1996

[54] APPARATUS FOR SUSPENDING AND MANOEUVRING A LOAD

[76] Inventor: Peter S. Foy, 3275 E. Patrick La., Las Vegas, Nev. 89120

[21] Appl. No.: 308,673

[22] Filed: Sep. 19, 1994

[51] Int. Cl.[6] ..... A63J 5/12

[52] U.S. Cl. ..... 212/333; 212/318; 472/80

[58] Field of Search ..... 472/80; 414/277, 414/280; 254/285; 212/318, 319, 333, 334, 335

[56] References Cited

U.S. PATENT DOCUMENTS

| | | | |
|---|---|---|---|
| 612,090 | 10/1898 | Conquest | 472/80 |
| 2,752,120 | 6/1956 | Bogle | 212/274 |
| 3,557,974 | 1/1971 | Ostrander | 414/277 |
| 3,768,668 | 10/1973 | Schukei | 212/319 |
| 4,392,648 | 7/1983 | Foy | 472/80 |
| 5,354,238 | 10/1994 | Gaughan | 472/80 |

*Primary Examiner*—Michael S. Huppert
*Assistant Examiner*—Thomas J. Brahan
*Attorney, Agent, or Firm*—Biebel & French

[57] ABSTRACT

An apparatus for suspending and manoevring a load, more particularly for providing a theatrical or stage effect in which an actor or article "flies", includes hoist means and means associated with the hoist means for rotating a load suspended therefrom, such that rotation of the load is unrestricted.

9 Claims, 3 Drawing Sheets

APPARATUS FOR SUSPENDING AND MANOEUVRING A LOAD

BACKGROUND OF THE INVENTION

This invention relates to an apparatus for suspending and manoeuvring a load and is more particularly, but not exclusively, concerned with the field of theatrical or stage effects, for example, the suspension of a person or article in theatrical "flying".

Known theatrical "flying" apparatus has the capability, among others, to rotate a person or article through 180°. However, greater angles of rotation have not hitherto been possible. Hence it would be desirable to alleviate this disadvantage and to provide for unrestricted rotation of a load.

SUMMARY OF THE INVENTION

It is an object of the invention to provide apparatus for suspending and manoeuvring a load including hoist means and means associated with said hoist means for rotating a load suspended therefrom, such that unrestricted rotation of the load can be obtained.

It is a further object of the invention to provide such an apparatus including a substantially vertical guide means, hoist means including a load bearing member guided by said guide means for non-rotating sliding movement therealong, means coupled to said load bearing member for raising and lowering said load bearing member along said guide means, rotatable frame means rotatably mounted on said guide means, support means rotatably mounted on said load bearing member for rotation with said frame means, and means for suspending said load from said support means.

As applied to a theatrical apparatus, the load will usually comprise one or more persons or articles and the apparatus will give the illusion that they are floating or flying.

BRIEF DESCRIPTION OF THE DRAWINGS

Further objects and advantages of the invention will appear from the following description taken in conjunction with the accompanying drawings, in which.

DESCRIPTION OF THE PREFERRED EMBODIMENT

Figure 1:
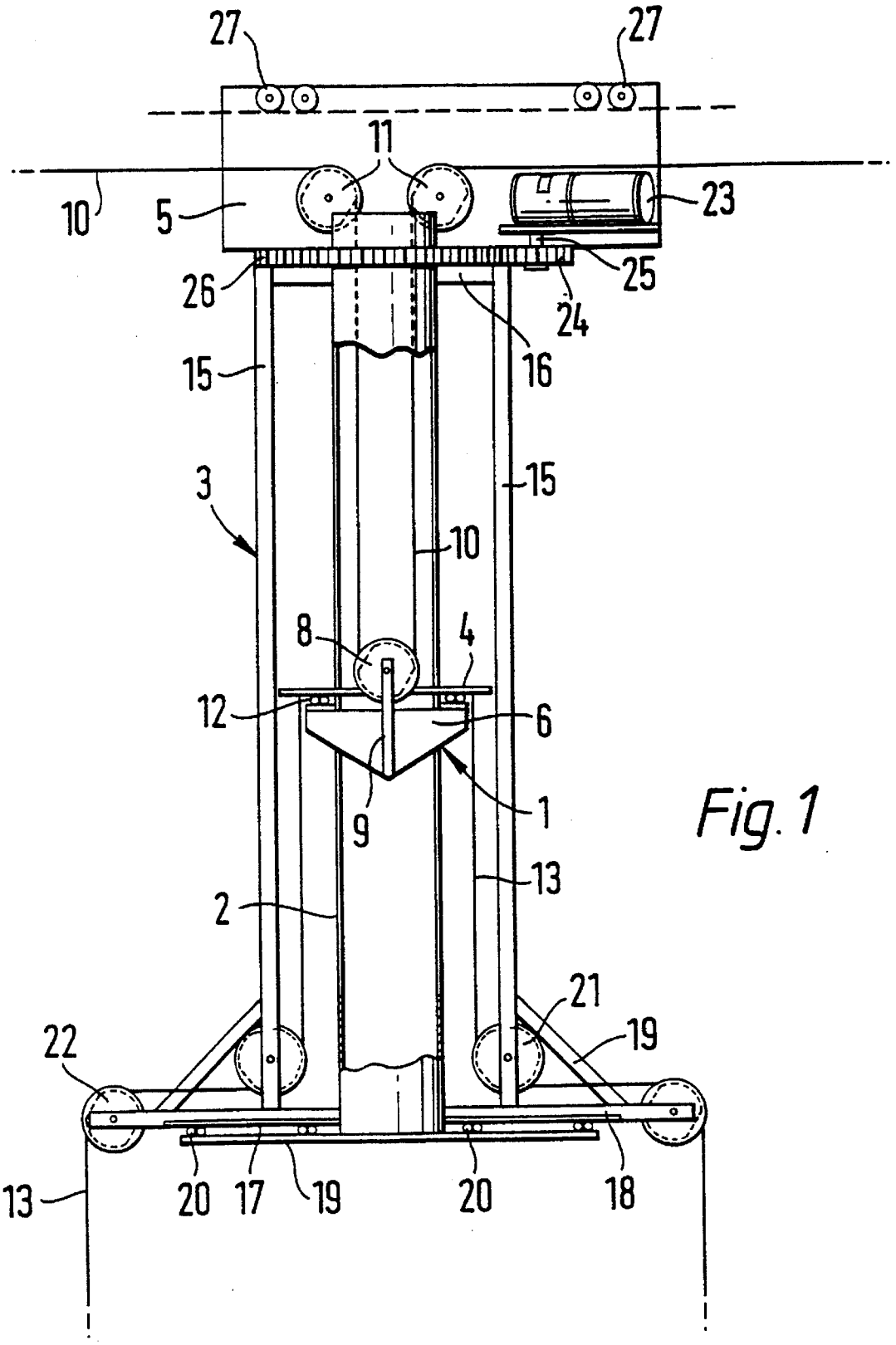
FIG. 1 is a schematic vertical section through one embodiment of an apparatus according to the invention.

Referring to the drawings, the apparatus basically comprises a hoist means 1, a guide means 2, a rotatable frame 3 mounted on the guide means and supported thereby, and support means 4 for a load rotatably mounted with respect to and supported by the hoist means 1.

The entire apparatus is suspended from a carriage 5 in the form of a vertical plate, mounted for horizontal movement as will be described later. A vertical cylinder forming the guide means 2 is fixed at its top edge to the lower edge of the carriage 5.

The hoist means 1 includes a load bearing member 6 in the form of a vertical plate whose opposite end portions extend through diametrically opposite vertical slots 7 in the guide 2. The slots 7 prevent any rotation of the load bearing member 6 relative to the guide 2. A pulley 8 rotatably mounted above the plate 6 by means of supports 9 carries a hoisting cable 10, which passes over two upper pulleys 11 mounted on the carriage 5. The hoisting cable runs vertically inside the guide 2 and is attached at one end thereof to a stationary fixture (not shown).

The load bearing plate 6 supports the support means 4, which is in the form of a horizontal disc, via rolling bearings 12 which allow the disc 4 to rotate. The disc 4 has a central circular aperture through which the guide 2 passes, thereby enabling the disc to be raised and lowered with the plate 6 relative to the guide 2.

Six cables 13, designated as load supporting cables to distinguish them from the hoisting cable 10, have one end attached to the hoisting disc 4, near its circumference, at equi-angular intervals.

A rotating frame 3, which serves to rotate the load supporting cables, consists of six vertical bars 15 which are spaced at equi-angular intervals and extend between an upper disc 16 and a lower disc 17. Both discs have a central aperture through which the cylindrical guide 2 passes with sufficient clearance to allow free rotation of the frame 14.

Figure 2:
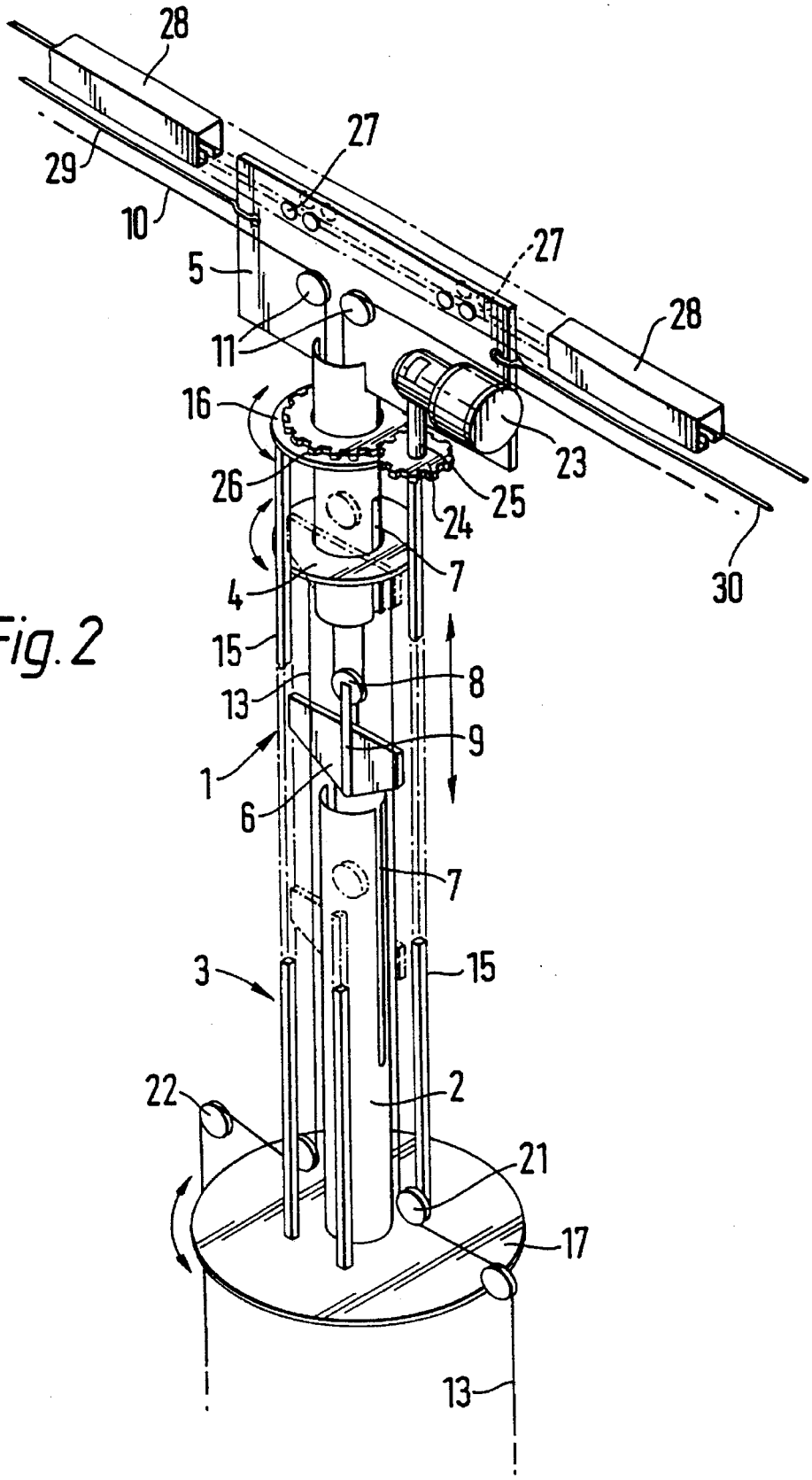
FIGS. 2 and 3 are schematic perspective views showing other aspects of the apparatus shown in FIG. 1.
Figure 3:
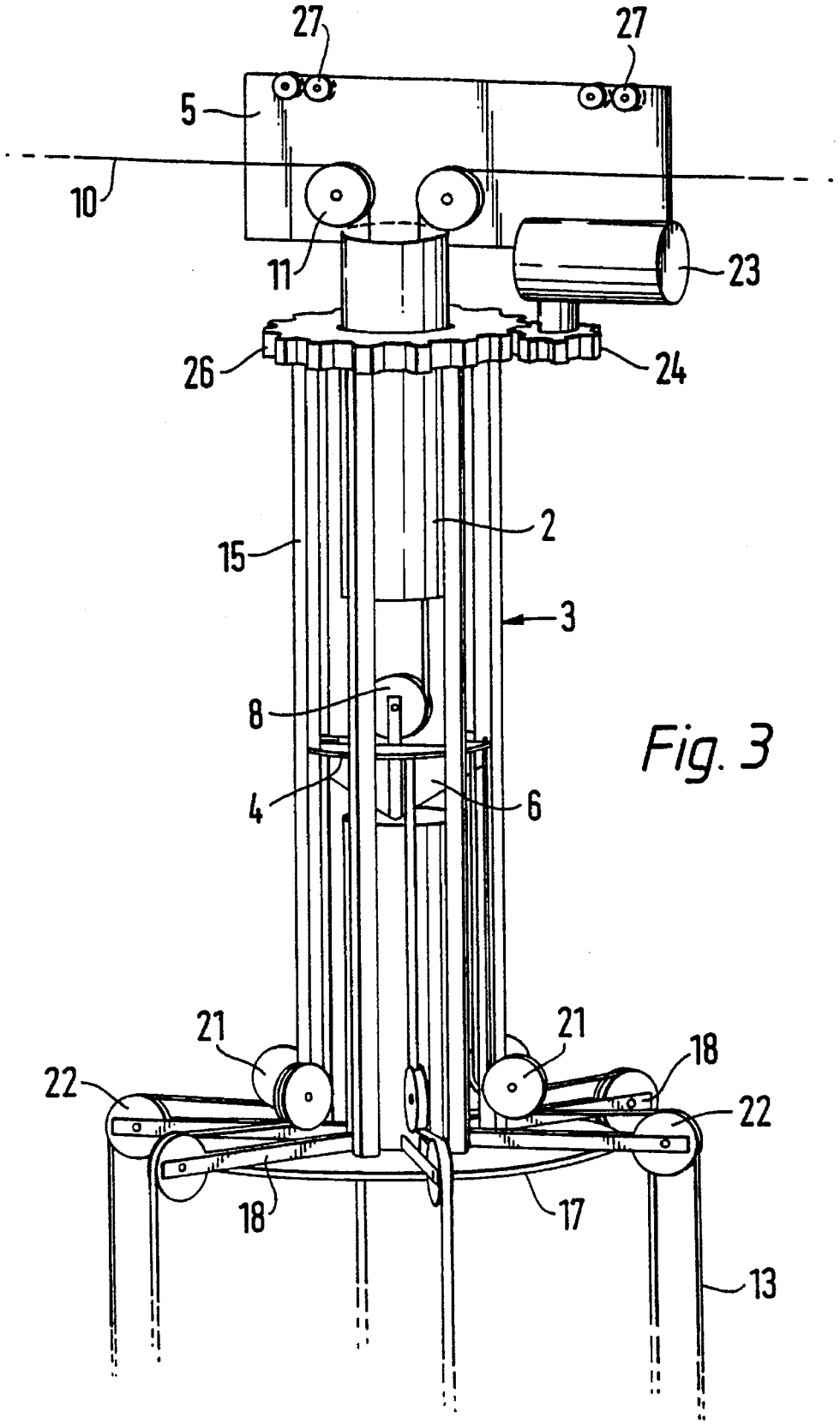

The lower end of each vertical bar 15 is connected to a horizontal bar 18, which extends radially outwards and may be supported by an inclined reinforcing strut 19, as shown in FIG. 1. For clarity, the horizontal bars 18 are not shown in FIG. 2 and the inclined struts are also omitted in FIGS. 2 and 3. As can be seen in FIG. 1, the guide 2 terminates at its lower end in a support plate 19 which underlies the lower disc 17 and supports the latter via rolling bearings 20 which hence allow rotation of the frame 14 with respect to the fixed guide 2.

Near the lower end of each vertical bar 14 is mounted a pulley 21 for rotation about a horizontal axis and a similar pulley 22 is mounted at the outer end of each horizontal bar 18. Again, for clarity, FIG. 2 only shows two of each type of pulley 8, 9. Each load supporting cable 13 runs vertically downwards from the disc 4 to be turned through a right angle by one of the pulleys 21 and is then guided over one of the pulleys 22. The cables can be releasably attached at their lower ends to the load (not shown), which may, for example, comprise one or more actors or pieces of scenery representing clouds or flying carpets. Where the load comprises a single unit, each cable 13 may be attached to a different part thereof. Alternatively, each cable may be attached to an individual item.

The carriage 5 carries an electric motor 23, which when activated drives a pinion 24 via a gearbox and a shaft 25 at right angles to the longitudinal axis of the motor 23. The pinion 24 in turn drives a larger annular gear 26 which is attached to the upper disc 16 and thus can cause rotation of the entire rotating assembly including the frame 3, pulleys 21, 22, disc 4 and load supporting cables 13. The disc 4 may slidably engage the vertical bars 15 of the frame 3 in order to ensure that the disc rotates through the same angle as the frame. Thus the load rotates about the axis of the guide 2.

When the free end of the hoisting cable 10 is pulled, either by means of a motor or manually, the load bearing member 6 is raised by means of the hoisting pulley 8 at a mechanical advantage of 2:1. This means that relatively heavy loads can easily be raised and can also be lowered by letting out the hoisting cable 10.

The carriage 5 has wheels 27 near its upper edge which run on a track 28 and this facilitates lateral movement of the entire apparatus and load along the track by hauling either of two horizontal cables 29, 30 which are attached to opposite ends of the carriage.

The apparatus as described above thus allows vertical, lateral and unlimited rotational movement of a load with independent control of each type of movement and without entanglement of any of the cables.

A further advantage of the invention, as illustrated by the embodiment described, results from the relatively small diameter of the part of the frame 3 formed by the vertical bars 15. This means that the apparatus can move laterally and rotate in a confined space, for example, behind hanging scenery. Only the components designated by reference numerals 17 to 22 would project out beneath such scenery.

In addition, the invention has advantages over prior apparatuses in which cables run from the uppermost point to the load with no rigid guide means. The provision of the rigid frame 3 and guide 2 means firstly that the apparatus itself is more easily controlled, and therefore safer, and secondly that the load is more controllable in that when it is close to the outer pulleys 22, only a slight "overswing" is visible due to movement of the load supporting cables 13, after the rigid parts of the apparatus have stopped moving.

Modifications may be made to the specific embodiment described as will be readily apparent to those skilled in the art. For example, instead of six cables 13, any suitable number of cables and associated parts could be provided, depending on the load, although a single horizontal bar and cable may be impractical due to the problem of balance. In an example having only two bars 18, the lower disc 17 may be omitted.

I claim:

1. An apparatus for suspending and manoeuvring a load including hoist means and means associated with said hoist means for rotating the load suspended therefrom, the improvement which permits unrestricted rotation of the load and which comprises:

a substantially vertical guide means, hoist means including a load bearing member guided by said guide means for non-rotating sliding movement therealong, and means coupled to said load bearing member for raising and lowering said load bearing member along said guide means, rotatable frame means rotatably mounted on said guide means, means for rotating said frame means about said guide means, support means rotatably mounted on said load bearing member for rotation with said frame means, and cable means having a fixed operative length attached to said support means for suspending said load from said support means, wherein said movement of said load bearing means within said substantially vertical guide means provides all of the raising and lowering of said load.

2. The apparatus of claim 1, wherein said means for raising and lowering said load bearing member comprises pulley means attached to said member and a cable arranged for selectively raising and lowering said member by said pulley means.

3. The apparatus of claim 1, wherein said substantially vertical guide means has at least one vertical slot and said load bearing member has a portion engaging the or each slot to prohibit rotation of said member.

4. The apparatus of claim 1, including frame pulley means attached to said frame means and guiding said cable means.

5. The apparatus of claim 1, wherein said vertical guide means has bearing means and said frame means has a lower annular end plate through which said guide means extends and which is rotatably supported by said bearing means.

6. The apparatus of claim 1, wherein said support means slidably engages said frame means to ensure that when said frame means rotates, said support means rotates through substantially the same angle.

7. The apparatus of claim 1, including carriage means from which said vertical guide means depends, said carriage means having wheel means for mounting said carriage means on a horizontal track along which said carriage means is traversable.

8. The apparatus of claim 1, including electric drive motor means for rotating said frame means, and gear means coupling said drive motor means to said frame means.

9. Theatrical apparatus for suspending and manoeuvring at least one actor or article to give an illusion of flying, comprising:

(a) carriage means having wheel means for mounting said carriage means on a horizontal track along which said carriage means is transversable, (b) a hollow vertical cylindrical guide means having an upper end fixed to said carriage means and depending from said carriage means to a lower end of said guide means, (c) hoist means including a load bearing member located within said guide means, cable and pulley means disposed between said load bearing member and said carriage means for selectively raising and lowering said load bearing member within said guide means, and means on said load bearing member engaging vertical slots in said guide means to prohibit turning of said load bearing member relatively to said guide means, (d) a rotatable frame mounted on said guide means and having upper and lower annular end plates through which said guide means extends, (e) bearing means supported on said guide means below said lower annular end plate of said frame, said lower annular end plate resting on said bearing means, whereby said frame is retained on said guide means and is permitted to rotate relatively thereto, (f) annular hoist means disposed about said guide means adjacent said load bearing member and slidably coupled to said frame, (g) bearing means supported on said load bearing member and mounting said annular hoist means on said load bearing member for raising and lowering with said load bearing member and for rotation relatively to said load bearing member, (h) a plurality of suspension cables fixed at upper ends to said annular hoist means and depending downwardly therefrom, (i) guide means carried by said frame means for spreading the suspension cables radially outwardly of said frame and said bearing means at the lower end of said guide means to dispose said suspension cables in a spaced circular array about said lower end of said guide means, (j) electric drive motor means for rotating said frame means mounted on said carriage means and coupled to said frame means by gear means.

* * * * *